US005632651A

United States Patent [19]

Szegda

[11] Patent Number: 5,632,651

[45] Date of Patent: May 27, 1997

[54] RADIAL COMPRESSION TYPE COAXIAL CABLE END CONNECTOR

[75] Inventor: Andrew Szegda, Canastota, N.Y.

[73] Assignee: John Mezzalingua Assoc. Inc., Manlius, N.Y.

[21] Appl. No.: 562,844

[22] Filed: Nov. 27, 1995

Related U.S. Application Data

[63] Continuation of Ser. No. 304,562, Sep. 12, 1994, Pat. No. 5,470,257.

[51] Int. Cl.[6] ..... H01R 9/05

[52] U.S. Cl. ..... 439/578

[58] Field of Search ..... 439/578–585, 439/836

[56] References Cited

U.S. PATENT DOCUMENTS

| | | |
|---|---|---|
| 2,549,647 | 4/1951 | Turenne . |
| 3,076,168 | 1/1963 | Keen . |
| 3,184,706 | 5/1965 | Atkins . |
| 3,292,136 | 12/1966 | Somerset . |
| 3,350,677 | 10/1967 | Daum . |
| 3,373,243 | 3/1968 | Janowiak et al. . |
| 3,448,430 | 6/1969 | Kelly . |
| 3,475,545 | 10/1969 | Stark et al. . |
| 3,498,647 | 3/1970 | Schroder . |
| 3,517,373 | 6/1970 | Jamon . |
| 3,533,051 | 10/1970 | Ziegler, Jr. . |
| 3,537,065 | 10/1970 | Winston . |
| 3,544,705 | 12/1970 | Winston . |
| 3,564,487 | 2/1971 | Upstone et al. . |
| 3,629,792 | 12/1971 | Dorrell . |
| 3,633,150 | 1/1972 | Swartz . |
| 3,694,793 | 9/1972 | Concelman . |
| 3,778,535 | 12/1973 | Forney, Jr. . |
| 3,781,762 | 12/1973 | Quackenbush . |
| 3,836,700 | 9/1974 | Niemeyer . |
| 3,879,102 | 4/1975 | Horak . |
| 3,910,673 | 10/1975 | Stokes . |
| 3,963,320 | 6/1976 | Spinner . |
| 3,976,352 | 8/1976 | Spinner . |
| 3,980,805 | 9/1976 | Lipari . |
| 3,985,418 | 10/1976 | Spinner . |
| 4,046,451 | 9/1977 | Juds et al. . |
| 4,053,200 | 10/1977 | Pugner . |
| 4,059,330 | 11/1977 | Shirey . |
| 4,093,335 | 6/1978 | Schwartz et al. . |
| 4,126,372 | 11/1978 | Hashimoto et al. . |
| 4,131,332 | 12/1978 | Hogendobler et al. . |
| 4,150,250 | 4/1979 | Lundeberg . |
| 4,165,554 | 8/1979 | Aujla . |
| 4,225,162 | 9/1980 | Dola . |
| 4,250,348 | 2/1981 | Kitagawa . |
| 4,280,749 | 7/1981 | Hemmer . |
| 4,408,821 | 10/1983 | Forney, Jr. . |
| 4,408,822 | 10/1983 | Nikitas . |

(List continued on next page.)

FOREIGN PATENT DOCUMENTS

| | | |
|---|---|---|
| 0072104 | 2/1983 | European Pat. Off. . |
| 0116157 | 8/1984 | European Pat. Off. . |

(List continued on next page.)

*Primary Examiner*—David L. Pirlot
*Assistant Examiner*—Brian J. Biggi
*Attorney, Agent, or Firm*—Samuels, Gauthier, Stevens & Reppert

[57] ABSTRACT

A radial compression type coaxial cable end connector has a connector body comprising a tubular inner post extending from a front end to a rear end, and an outer collar surrounding and fixed relative to the inner post at a location disposed rearwardly of the front post end. The outer collar cooperates in a radially spaced relationship with the inner post to define an annular chamber with a rear opening. A fastener at the front end of the inner post serves to attach the end connector to a system component. A tubular locking member protrudes axially into the annular chamber through its rear opening. The tubular locking member is integrally coupled to the connector body and is displaceable axially between an open position accommodating insertion of the tubular inner post into a prepared cable end, with an annular outer portion of the cable being received in the annular chamber, and a clamped position fixing the annular cable portion within the chamber.

19 Claims, 3 Drawing Sheets

U.S. PATENT DOCUMENTS

| | | |
|---|---|---|
| 4,421,377 | 12/1983 | Spinner . |
| 4,444,453 | 4/1984 | Kirby et al. . |
| 4,456,323 | 6/1984 | Pitcher et al. . |
| 4,515,427 | 5/1985 | Smit . |
| 4,540,231 | 9/1985 | Forney, Jr. . |
| 4,545,637 | 10/1985 | Bosshard et al. . |
| 4,575,274 | 3/1986 | Hayward . |
| 4,583,811 | 4/1986 | McMillis . |
| 4,596,434 | 6/1986 | Saba et al. . |
| 4,598,961 | 7/1986 | Cohen . |
| 4,600,263 | 7/1986 | DeChamp et al. . |
| 4,614,390 | 9/1986 | Baker . |
| 4,632,487 | 12/1986 | Wargula . |
| 4,655,159 | 4/1987 | McMills . |
| 4,666,229 | 5/1987 | Grand . |
| 4,668,043 | 5/1987 | Saba et al. . |
| 4,674,818 | 6/1987 | McMills et al. . |
| 4,676,577 | 6/1987 | Szegda . |
| 4,682,832 | 7/1987 | Punako et al. . |
| 4,688,876 | 8/1987 | Morelli . |
| 4,688,878 | 8/1987 | Cohen et al. . |
| 4,703,987 | 11/1987 | Gallusser et al. . |
| 4,755,152 | 7/1988 | Elliot et al. . |
| 4,761,146 | 8/1988 | Sohoel . |
| 4,772,222 | 9/1988 | Laudig et al. . |
| 4,834,675 | 5/1989 | Samchisen . |
| 4,834,676 | 5/1989 | Tackett . |
| 4,874,331 | 10/1989 | Iverson . |
| 4,902,246 | 2/1990 | Samchisen . |
| 4,927,385 | 5/1990 | Cheng . |
| 4,952,174 | 8/1990 | Sucht et al. . |
| 4,957,456 | 9/1990 | Olson et al. . |
| 4,979,911 | 12/1990 | Spencer . |
| 5,002,503 | 3/1991 | Campbell et al. . |
| 5,007,861 | 4/1991 | Stirling . |
| 5,024,606 | 6/1991 | Ming-Hwa . |
| 5,073,129 | 12/1991 | Szegda . |
| 5,083,943 | 1/1992 | Tarrant . |
| 5,120,260 | 6/1992 | Jackson . |
| 5,127,853 | 7/1992 | McMillis et al. . |
| 5,207,602 | 5/1993 | McMillis et al. . |
| 5,269,701 | 12/1993 | Liebfried, Jr. . |
| 5,284,449 | 2/1994 | Vaccaro . |
| 5,295,864 | 3/1994 | Birch et al. . |
| 5,342,218 | 8/1994 | McMillis et al. . |
| 5,456,611 | 10/1995 | Henry et al. . |
| 5,466,173 | 11/1995 | Down . |
| 5,470,257 | 11/1995 | Szegda . |

FOREIGN PATENT DOCUMENTS

| | | |
|---|---|---|
| 0167738 | 1/1986 | European Pat. Off. . |
| 2232846 | 6/1974 | France . |
| 2234680 | 6/1974 | France . |
| 2462798 | 8/1979 | France . |
| 102289 | 1/1958 | Germany . |
| 1117687 | 11/1961 | Germany . |
| 47931 | 5/1966 | Germany . |
| 1515398 | 4/1970 | Germany . |
| 2221936 | 11/1973 | Germany . |
| 2225764 | 6/1974 | Germany . |
| 2261973 | 6/1974 | Germany . |
| 3211008 | 10/1983 | Germany . |
| 589697 | 6/1947 | United Kingdom . |
| 2079549 | 1/1983 | United Kingdom . |
| WO93/24973 | 12/1993 | WIPO . |
| WO96/08854 | 3/1996 | WIPO . |

RADIAL COMPRESSION TYPE COAXIAL CABLE END CONNECTOR

This is a continuation of application Ser. No. 08/304,562 filed on Sep. 12, 1994, now U.S. Pat. No. 5,470,257.

BACKGROUND OF THE INVENTION

1. Field of the Invention

This invention relates to coaxial cable end connectors of the type employed in the cable television industry.

2. Description of the Prior Art

The conventional coaxial cable typically consists of a centrally located inner electrical conductor surrounded by and spaced inwardly from an outer cylindrical electrical conductor. The inner and outer conductors are separated by a dielectric insulating sleeve, and the outer conductor is encased within a protective dielectric jacket. The outer conductor can comprise a sheath of fine braided metallic strands, a metallic foil, or multiple layer combinations of either or both.

Conventional coaxial cable end connectors typically include an inner cylindrical post adapted to be inserted into a suitably prepared end of the cable between the dielectric insulating sleeve and the outer conductor, an end portion of the latter having been exposed and folded back over the outer dielectric jacket. The inner conductor and the dielectric insulating sleeve thus comprise a central core portion of the cable received axially in the inner post, whereas the outer conductor and dielectric jacket comprise an annular outer portion of the cable surrounding the inner post.

The conventional coaxial cable end connector further includes an outer component designed to coact with the inner post in securely and sealingly clamping the annular outer portion of the cable therebetween. In "crimp type" end connectors, the outer component comprises a sleeve fixed in relation to and designed to be deformed radially inwardly towards the inner post. Typical examples of crimp type end connectors are described in U.S. Pat. No. 5,073,129 (Szegda) and U.S. Pat. No. 5,083,943 (Tarrant).

In the so-called "radial compression type" end connectors, the outer component comprises a substantially non-deformable sleeve adapted to be shifted axially with respect to the inner post into a clamped position coacting with the inner post to clamp the prepared cable end therebetween. Typical examples of radial compression type connectors are described in U.S. Pat. No. 3,498,647 (Schroder); U.S. Pat. No. 3,985,418 (Spinner); U.S. Pat. No. 4,059,330 (Shirey); U.S. Pat. No. 4,444,453 (Kilry et al); U.S. Pat. No. 4,676,577 (Szegda); and U.S. Pat. No. 5,024,606 (Yeh Ming-Hwa).

These radial compression type end connectors suffer from a common disadvantage in that prior to being mounted on the cable ends, the outer sleeve components are detached and separate from the inner posts. As such, the outer sleeve components are prone to being dropped or otherwise becoming misplaced or lost, particularly, as is often the case, when an installation is being made outdoors under less than ideal weather conditions.

In U.S. Pat. No. 4,834,675 (Samchisen), an attempt has been made at addressing this problem by detachably interconnecting the connector body and outer sleeve component in a parallel side-by-side relationship. This facilitates pre-installation handling and storage. However, during installation, the outer sleeve component must still be detached from the connector body and threaded onto the cable as a separate element. Thus, mishandling or loss of the outer sleeve component remains a serious problem during the critical installation phase.

U.S. Pat. No. 5,295,864 (Birch et al) discloses a radial compression type end connector with an integral outer sleeve component. Here, however, the outer sleeve component is shifted into its clamped position as a result of the connector being threaded onto an equipment port or the like. Prior to that time, the end connector is only loosely assembled on and is thus prone to being dislodged from the cable end. This again creates problems for the installer.

In light of the foregoing, an objective of the present invention is the provision of an improved radial compression type end connector wherein the outer sleeve component remains at all times integrally connected to the inner post, both prior to and during installation.

A companion objective of the present invention is the provision of an integrally assembled radial compression type end connector wherein the outer sleeve component is shiftable to a clamped position prior to and independently of the installation of the end connector on an equipment port or other like system component.

Still another objective of the present invention is the provision of a radial compression type end connector having improved holding power and pull resistance.

SUMMARY OF THE INVENTION

The radial compression type connector of the present invention has a connector body comprising an inner post extending from a front end to a rear end, and an outer collar surrounding and fixed relative to the inner post at a location disposed rearwardly of the front end. The outer collar cooperates in a radially spaced relationship with the inner post to define an annular chamber with a rear opening. A fastener on the front end of the tubular post serves to attach the end connector to an equipment port or other like system component. A tubular locking member protrudes axially into the annular chamber through its rear opening. The locking member and the connector body are integrally coupled in a manner accommodating limited axial movement of the locking member between a first "open" position and a second "clamped" position. When in the first position, the locking member accommodates insertion of the rear end of the inner post into an end of an appropriately prepared cable, with a central core portion of the cable being received in the inner post and an outer annular portion of the cable being received in the annular chamber. When shifted to the second position, the locking member coacts with the inner post to grip and firmly clamp the outer annular portion of the cable therebetween.

Preferably, integral coupling is effected by an interengagement of the locking member with the outer collar of the connector body. The interengagement between these components resists rearward axial withdrawal of the tubular locking member from its first position, and yieldably accommodates movement of the tubular locking member in a forward direction only from its first position to its second position where it is retained.

A large area of the annular outer cable portion is gripped between the inner post and the locking member, thus providing improved holding power and pull resistance without cutting or otherwise damaging the cable.

These and other objectives, features and advantages of the present invention will be described in greater detail with reference to the accompanying drawings, wherein:

DETAILED DESCRIPTION OF PREFERRED EMBODIMENTS

Figure 1:
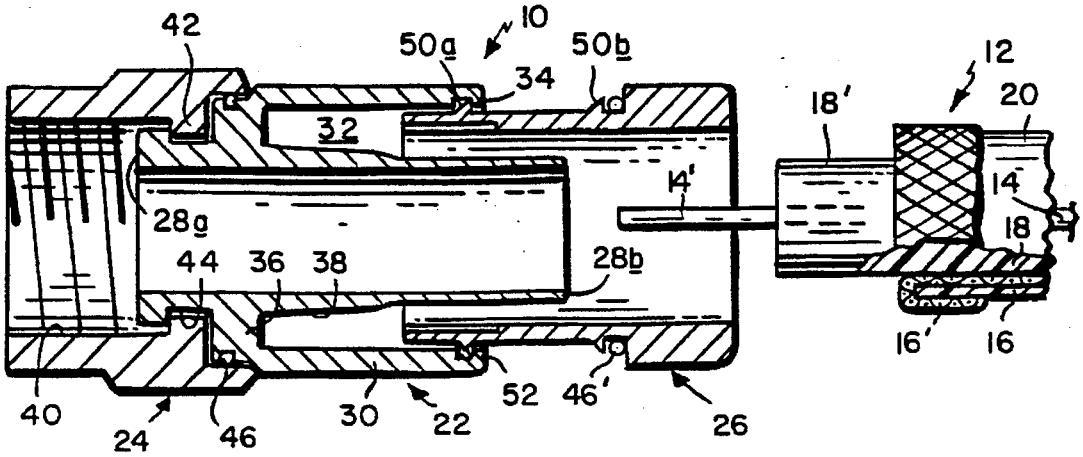
FIG. 1 is a longitudinal sectional view of one embodiment of an end connector according to the present invention, shown adjacent to the prepared end of a coaxial cable.

Referring initially to FIG. 1, an end connector in accordance with the present invention is generally depicted at 10 adjacent to the prepared end of a coaxial cable 12. Cable 12 is of a known type comprising an electrical inner conductor 14 surrounded by and spaced radially inwardly from an outer conductor 16 by a dielectric insulating sleeve 18. The outer conductor 16 can comprise a sheath of fine braided metallic strands, a metallic foil, or multiple layer combinations of either or both. A dielectric covering or jacket 20 surrounds the outer conductor 16 and comprises the outermost layer of the cable.

An end of the cable is prepared to receive the end connector 10 by selectively removing various layers to progressively expose an end 14' of the inner conductor, an end 18' of the insulating sleeve, and an end portion 16' of the outer conductor folded over the insulating jacket 20.

Figure 2:
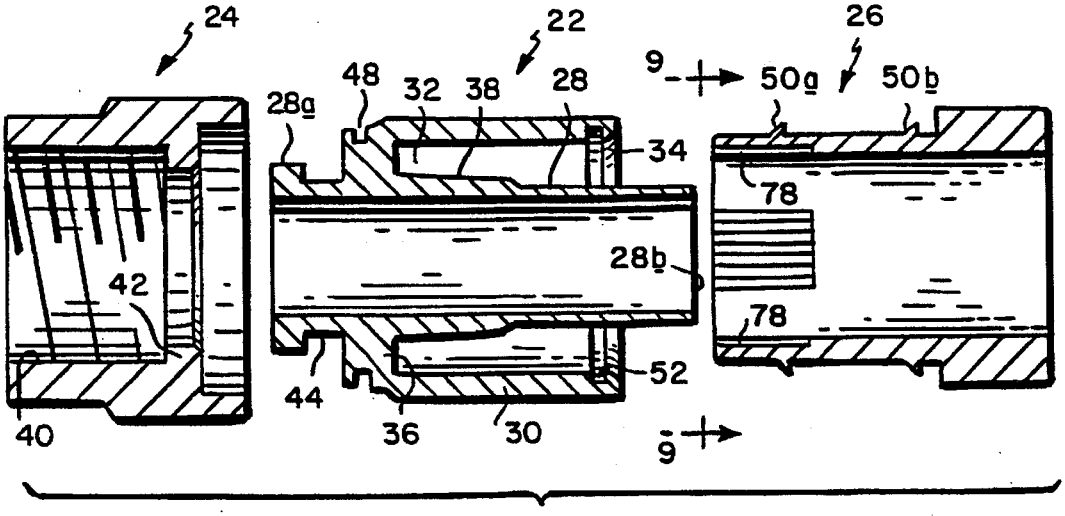
FIG. 2 is an exploded longitudinal sectional view of the major components of the end connector shown in FIG. 1.

Referring additionally to FIG. 2, it will be seen that the end connector 10 includes a connector body 22, a cylindrical fastener 24 and a tubular locking member 26. The connector body 22 comprises a tubular inner post 28 extending from a front end 28*a* to a rear end 28*b*, and an outer cylindrical collar 30 surrounding and fixed relative to the inner post at a location disposed rearwardly of the front end 28*a*. The outer collar 30 cooperates in a radially spaced relationship with the inner post to define an annular chamber 32 accessible via a rear opening 34.

Preferably, the outer collar 30 and the inner post are formed integrally as a single piece, with an integral circular flange 36 extending radially therebetween to close off the inner end of annular chamber 32. Alternatively, the outer collar 30 and flange 36 can comprise a separate piece press fitted onto the outer surface of the inner post 28.

The outer surface of the inner post 28 is configured with a radially enlarged or flared portion 38 within the annular chamber 32 and at a location proximate to the circular flange 36 and remote from the rear opening 34. Preferably, the flared portion defines a truncated conical surface with its maximum diameter closer in proximity to the circular flange 36 than to the rear opening 34.

The fastener 24 is internally threaded as at 40 and is provided with an inner circular shoulder 42 seated in a circular groove 44 in the outer surface of the post 28 at a location adjacent to the front end 28*a*. The fastener 24 and inner post 28 are relatively rotatable, with an optional O-ring seal 46 seated in a second groove 48 and serving as a moisture barrier.

Figure 5:
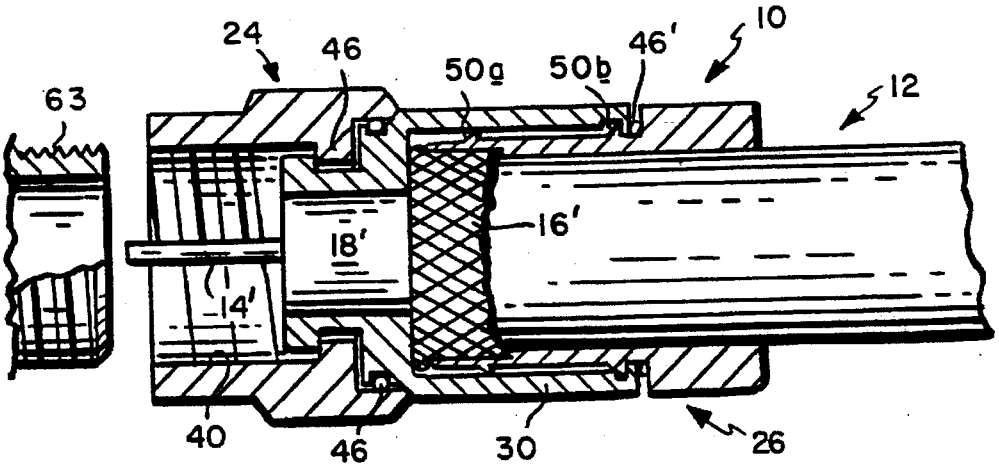
FIG. 5 is a view similar to FIG. 4, but showing the locking member advanced to its second clamped position.

The tubular locking member 26 protrudes axially through rear opening 34 into the annular chamber 32. Engagement means serve to integrally couple the locking member 26 to the connector body 22 for limited axial movement relative to both the inner post 28 and the outer collar 30 between a first "open" position as illustrated in FIG. 1, and a second "clamped" position as shown in FIG. 5. The engagement means preferably comprises first and second axially spaced radially protruding circular shoulders 50*a*, 50*b* on the locking member 26, each shoulder being configured and dimensioned to coact in a snap engagement with an internal groove 52 at the rear end of the outer collar 30.

Figure 3:
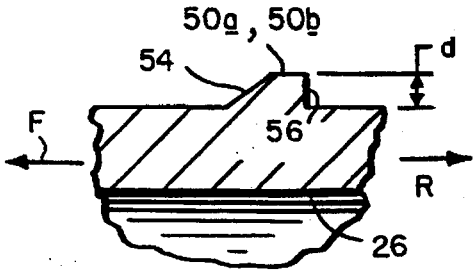
FIG. 3 is an enlarged sectional view of a portion of the tubular locking member.

As can be best seen in FIG. 3, the shoulders 50*a*, 50*b* protrude from the surface of the locking member by a radial distance "d", and are each provided with an inclined ramp-like front face 54 and a generally perpendicular rear face 56. The front faces 54 accommodate movement of the shoulders out of the groove 52 in a forward axial direction (arrow "F" in FIG. 3), whereas the rear faces 56 resist movement of the shoulders out of the groove 52 in a rearward axial direction (arrow "R" in FIG. 3).

Figure 4:
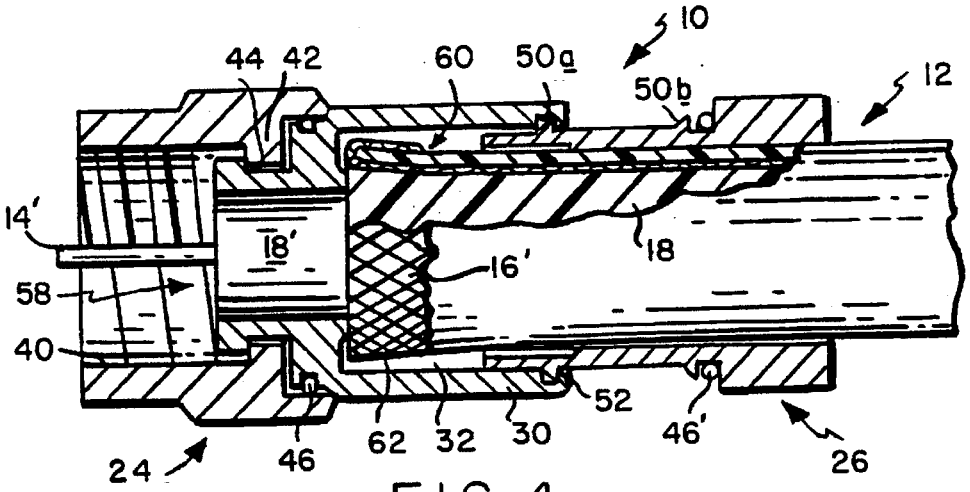
FIG. 4 is a longitudinal sectional view similar to FIG. 1, showing the end connector mounted on the prepared cable end, but prior to displacement of the locking member from the first open position to the second clamped position.

When installing the end connector 10 on the prepared end of a coaxial cable, the rear end 28*b* of the inner post 28 is first inserted axially into the cable end. As shown in FIG. 4, the cable end is thus subdivided into a central core portion 58 comprising the inner conductor 14 and dielectric sleeve 18, and an outer annular portion 60 comprising the outer conductor 16 folded over the end of the outer dielectric jacket 20. The central core portion 58 is received in the inner post through its rear end 28*b*, and extends axially therethrough to an extent permitting the exposed end 14' of the inner conductor to protrude beyond the fastener 24. At the same time the outer annular portion 60 is received between the locking member 26 and the inner post 28 into the annular chamber 32 through its rear opening 34. The flared portion 38 of the inner post 28 serves to radially expanded the outer annular portion 60 of the cable into the annular chamber 32, thus presenting an outwardly flared truncated conical surface 62 lying in the path of the rearwardly retracted locking member 26, the latter being held in that position by the snap engagement of shoulder 50*a* in groove 52.

As shown in FIG. 5, the locking member 26 is then advanced axially, causing the shoulder 50*a* to disengage itself from groove 52, and resulting in the outwardly flared surface 62 of the outer annular cable portion 60 being slidably contacted and pressed inwardly by the locking member. As a result, the radially expanded annular outer portion of the cable is firmly clamped between the inner surface of the locking member 26 and the flared outer portion 38 of the inner post. Final locking in the clamped position occurs when the shoulder 50*b* coacts in snapped engagement with the groove 52. A second optional O-ring 46' is disposed rearwarly of the shoulder 50*b* and serves to provide a moisture barrier between the locking member 26 and the outer collar 30 of the connector body 22. The fastener 24 may then be employed to attach the connector to a system component, typically a threaded port 63 or the like.

Figure 6:
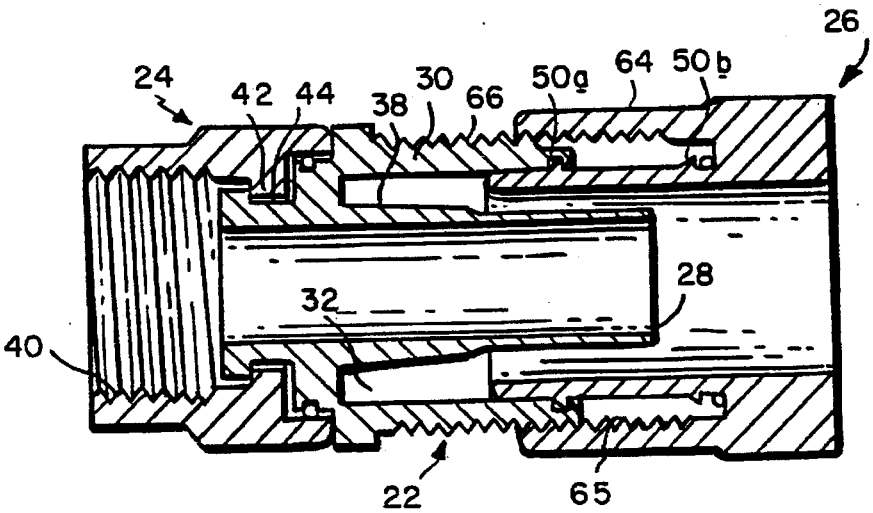
FIG. 6 is a longitudinal sectional view of an alternative embodiment of an end connector in accordance with the present invention.

Axial advancement of the locking member 26 relative to the connector body 22 can be effected by an appropriately designed plier-like tool (not shown). Alternatively, as shown in FIG. 6, the locking member can be provided with a collar 64 having internal threads 65 arranged to coact in threaded engagement with external threads 66 on the collar 30 of the connector body. Rotation of the locking member 26 relative to the connector body 22 will thus result in an advancement of the locking member from its open position to its clamped position.

Figure 7A:
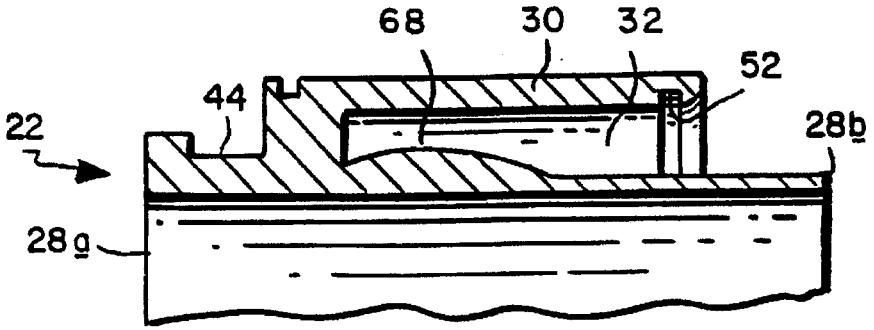
FIGS. 7A and 7B are partial sectional views showing differently configured flared portions of the connector body.
Figure 7B:
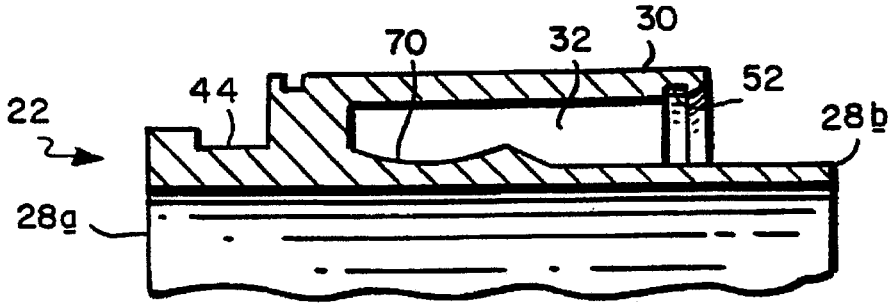

While the flared portion 38 of the inner post 28 is preferably configured as a truncated cone, other flared configurations might include an externally convex shape as shown at 68 in FIG. 7A, or an externally concave shape as shown at 70 in FIG. 7B.

Figure 8:
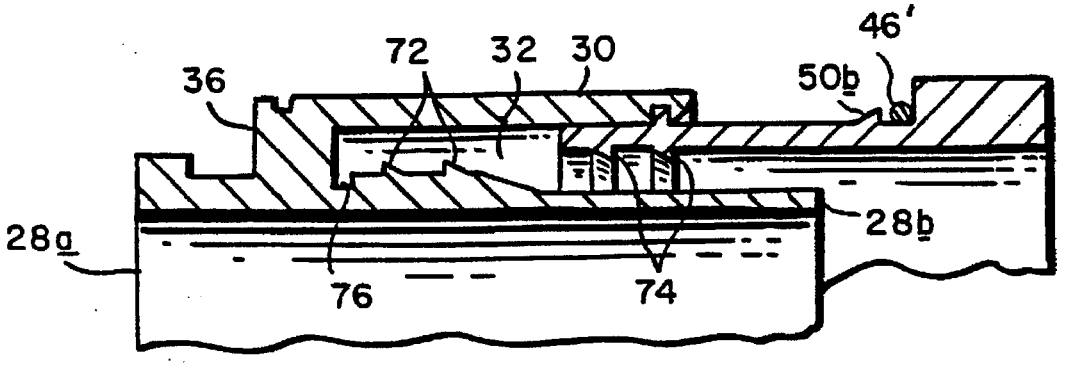
FIG. 8 is a partial sectional view showing toothed configurations on the clamping surfaces of the inner post and locking member.

As shown in FIG. 8, the flared portion might be provided additionally with teeth 72 pointing inwardly towards the inner end of the chamber 32. Additional teeth 74 could be provided on the inner surface of the locking member 26. Teeth 72 and 74 could be employed alternatively, or in concert.

Also, as shown in FIG. 8, the ramp-like surface of the flared conical portion could lead to a groove 76 directly adjacent to the circular flange 36. The end of the annular outer cable portion would be deformed into the groove 76 to thereby further promote axial holding power.

Figure 9A:
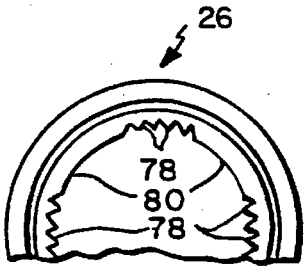
FIG. 9A is a partial front end view of the locking member taken along line 9—9 of FIG. 2.
Figure 9B:
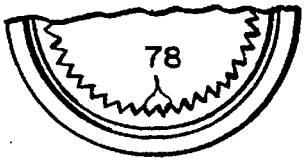
FIG. 9B is a view similar to FIG. 9A showing a modified embodiment.

As can be further seen by a comparison of FIGS. 2 and 9A, the inner surface of the front end of the locking member 26 may be provided with longitudinally extending teeth 78. The teeth may be circumferentially separated into groups by partially cylindrical lands 80, or as shown in FIG. 9B, they may be arranged around the full interior circumference of the front end. The teeth 78 provide increased holding power and resist rotation of the cable in relation to the installed connector.

In all cases, the coaction of shoulder 50*a* with groove 52 serves to retain the connector body and locking member in an assembled state during storage, handling, and installation on a cable end. This eliminates any danger of the locking member being dropped or otherwise mishandled during assembly. The shoulder 50*b* coacts with groove 52 to retain the locking member in its final clamped position.

In light of the foregoing, it will now be appreciated by those skilled in the art that modifications may be made to the disclosed embodiments without departing from the spirit and scope of the invention as defined by the appended claims. For example, the extent of radial protrusion "d" of shoulder 50*b* can be increased as compared to that of shoulder 50*a*, thus providing greater holding power in the second clamped position. Also, the shoulders 50*a*, 50*b* can be provided with oppositely inclined surfaces, thus making it easier to disassemble the locking member from the connector body. The design of the fastener 24 can also be changed to suit differing applications.

I claim:

1. An end connector for connecting a coaxial cable to a system component, said end connector comprising:

a connector body comprising a tubular inner post extending from a front end to a rear end, and including an outer collar surrounding and fixed relative to said inner post at a location disposed rearwardly of said front end, said outer collar cooperating in a radially spaced relationship with said inner post to define an annular chamber with a rear opening;

fastener means at the front end of said inner post for attaching said end connector to said system component;

a tubular locking member; and engagement means for inseparably coupling said locking member to said connector body at a first position partially inserted through said rear opening into said annular chamber and at which first position said locking member protrudes axially rearwardly from said connector body and overlaps and coacts in a radially spaced relationship with said inner post to accommodate insertion of the rear end of said inner post into an end of said cable, with a central core portion of said cable being received in said inner post through said rear end and an outer annular portion of said cable being received in said annular chamber through said rear opening and between said locking member and said inner post, said engagement means being yieldably releasable in response to an axially directed force to accommodate a further axial insertion of said locking member into said annular chamber to a second position at which said locking member coacts with said inner post to grip the outer annular portion of said cable therebetween.

2. The end connector of claim 1 wherein said engagement means releasably retains said locking member in said first position and accommodates movement of said locking member from said first position in one direction only to said second position.

3. The end connector of claim 2 further comprising second engagement means for fixing said locking member at said second position.

4. The end connector of claim 1 wherein said annular chamber is closed at a first end by a circular flange extending radially between said inner post and said outer collar.

5. The end connector of claim 4 wherein the outer surface of said inner post is configured with a flared portion located within said annular chamber, the maximum diameter of said flared portion being closer in proximity to said circular flange than to said rear end.

6. The end connector of claim 5 wherein said flared portion defined a truncated conical surface converging towards said rear end.

7. The end connector of claims 5 or 6 wherein said tubular locking member coacts in said second position with the flared portion of said inner post to grip the outer annular portion of said cable therebetween.

8. The end connector of claim 4 wherein the coaction of said tubular locking member with said inner post to grip the outer annular portion of said cable therebetween occurs at a location proximate to said circular flange and remote from the rear opening of said annular chamber.

9. The end connector of claim 1 wherein said engagement means comprises a circular groove on an interior surface of said collar, and a circular radial protrusion on an exterior surface of said locking member.

10. An integral end connector for connecting a coaxial cable to a system component, said end connector comprising:

a connector body having a tubular inner post extending from a front end to a rear end, with an outer collar surrounding and fixed relative to said inner post by means of a circular flange extending radially therebetween at a location disposed rearwardly of said front end, said collar cooperating in a radially spaced relationship with said post to define an annular chamber closed at the forward end by said circular flange and having a rear opening, the outer surface of said inner post having a radially enlarged portion remote from said rear end and adjacent to said circular flange;

fastener means at the front end of said inner post for attaching said end connector to said system component; and a tubular locking member inseparably coupled to said connector body and protruding into said annular chamber through said rear opening, said locking member being movable axially relative to said connector body between first and second positions, said tubular locking member when in said first position protruding axially rearwardly from said connector body to accommodate insertion of the rear end of said inner post into an end of said cable, with a central core portion of said cable being received in said inner post through said rear end and an outer annular portion of said cable being received between said locking member and said inner post into said annular chamber through said rear opening, and said tubular locking member when in said second position coacting with the radially enlarged portion of the outer surface of said inner post to grip the outer annular portion of said cable therebetween.

11. The end connector of claim 10 wherein said collar is spaced forwardly of said rear end.

12. The end connector of claim 10 wherein said radially enlarged portion diverges forwardly towards said circular flange.

13. The end connector of claim 12 wherein said radially enlarged portion has a truncated conical configuration.

14. The end connector of claim 10 wherein said radially enlarged portion is externally convex.

15. The end connector of claim 10 wherein said radially enlarged portion is externally concave.

16. The end connector according to anyone of claims 10–15 wherein said radially enlarged portion is spaced from said circular flange by a circular groove in the outer surface of said inner post.

17. The end connector according to anyone of claims 10–15 wherein said radially enlarged portion and the portion of said locking member have coacting teeth adapted to grip the annular portion of said cable located therebetween.

18. The end connector of claim 10 wherein said circular flange is integral to said outer collar and press fitted onto said inner post.

19. The end connector of claim 10 wherein said circular flange is integral to both said outer collar and said inner post.

* * * * *